US006988884B2

(12) United States Patent
Wong

(10) Patent No.: US 6,988,884 B2
(45) Date of Patent: Jan. 24, 2006

(54) UTILITY LIGHTER WITH SAFETY DEVICE

(76) Inventor: Chi Lam Wong, 1617 S. Euclid Ave., San Gabriel, CA (US) 91776

( * ) Notice: Subject to any disclaimer, the term of this patent is extended or adjusted under 35 U.S.C. 154(b) by 114 days.

(21) Appl. No.: 10/792,321

(22) Filed: Mar. 2, 2004

(65) Prior Publication Data

US 2005/0196717 A1 Sep. 8, 2005

(51) Int. Cl.
*F23D 11/36* (2006.01)

(52) U.S. Cl. ..... 431/153; 431/255

(58) Field of Classification Search ..... 431/153, 431/255

See application file for complete search history.

(56) References Cited

U.S. PATENT DOCUMENTS 6,669,466 B2 * 12/2003 Dijkstra ..... 431/153
6,688,879 B2 * 2/2004 Tsai ..... 431/153
2004/0121276 A1 * 6/2004 Erdmann ..... 431/153
2005/0053880 A1 * 3/2005 Kim ..... 431/153

* cited by examiner

*Primary Examiner*—Alfred Basichas

(74) *Attorney, Agent, or Firm*—Raymond Y. Chan; David and Raymond

(57) ABSTRACT

A safety device for a utility lighter includes a pusher button slidably mounted on a lighter housing for simultaneously lifting up the gas valve and compressing the piezoelectric unit, a restraining latch transversely extended in the lighter housing, and a safety rotor, which is rotatably connected to the pusher button, having a blocking latch to normally align with the restraining latch to block the upwardly movement of the pusher button for ignition. To ignite the lighter, an adult's thumb has to downwardly rotate the safety rotor to offset the blocking latch with the restraining latch and upwardly push the pusher button in one sequential manner.

31 Claims, 7 Drawing Sheets

UTILITY LIGHTER WITH SAFETY DEVICE

BACKGROUND OF THE PRESENT INVENTION

1. Field of Invention

The present invention relates to a lighter, and more particularly to a utility lighter with a safety device which defines a safety distance through which a thumb of a user's hand has to be traveled for triggering the utility lighter.

2. Description of Related Arts

A conventional utility lighter usually comprises a lighter case, a fuel-storage chamber having a gas release nozzle provided n the lighter case for storing liquefied gaseous fuel and releasing the gaseous fuel when the has release nozzle is uplifted, a piezoelectric unit, and an ignition triggering device.

The piezoelectric unit comprises a fixed part and a movable part movably attached thereto wherein when the movable element is depressed with respect to the fixed element, a piezoelectric spark will be generated for ignition.

The ignition triggering device comprises a trigger button slidably mounted on the lighter case and operatively communicated with the piezoelectric unit, and a lever pivotally communicating the gas release nozzle with the trigger button in such a manner that when the trigger button is slidably depressed, the lever will pivotally uplift the gas release nozzle so as to release the gaseous fuel. Simultaneously, the movable part of the piezoelectric unit is depressed wherein gaseous fuel coming out from the gas release nozzle is arranged to be ignited by the piezoelectric spark generate from the piezoelectric unit.

The major disadvantage of the conventional utility lighter is too easy and convenient for the user to ignite. Essentially, the user needs only to depress the trigger button in order to ignite the lighter. Thus, one can conceive that even a child can ignite the lighter without any difficulty.

This may lead to an extremely disastrous consequence. For example, the child may burn himself/herself by curiously igniting the lighter. What's worse is that when the fire accidentally ignite something, it may cause a large-scale fire.

Admittedly, a lot of conventional piezoelectric lighters have been further developed as comprising some sorts of safety devices so as to prevent undesired or accidental ignition. However, as a general phenomenon, the greater the complexity of the safety device, the more effective the prevention of accidental ignition, yet the more inconvenience when the user tries to ignite the lighter. As a result, there a considerable number of piezoelectric lighters wherein their safety devices are so effective in preventing accidental ignition yet also effective in discouraging people using them because of the intolerably inconvenience for utilizing them.

Obviously, as a matter of fact, there exist a considerable amount of utility lighters wherein their safety devices are convenient to operate so that people are more willing to use them. However, very often, those safety devices so easy to operate that even a child can ignite the utility lighter without much difficulty. Although it can not be said that those safety devices are of no use, their practical utility value are undeniably very limited.

As a result, a very difficult balance has to be struck between inconvenience and ineffectiveness of the safety devices. As children tend to learn fast, it is indeed very hard to prevent them from understanding how a safety device functions thus effectively prohibiting accidental ignition by children.

Poor handling of such issues will lead to a result that neither convenient operation of the utility lighters nor effective prevention of accidental and undesirable ignition could be achieved.

SUMMARY OF THE PRESENT INVENTION

A main object of the present invention is to provide a utility lighter, which comprises a safety device for locking the ignition operation of the utility lighter, such that the utility lighter requires two continuous actions, namely, vertically rotating a safety rotor and opposedly pushing the pusher button, in order to ignite the utility lighter.

Another object of the present invention is to provide a utility lighter comprising a safety device which defines a safety distance which an adult user's thumb has to move before he/she can be able to ignite the utility lighter. In other words, because a child's thumb, being smaller in size as compared with an adult's thumb, is incapable of moving through the whole safety distance, therefore he/she is prevented from igniting the lighter.

Another object of the present invention is to provide a utility lighter comprising a safety device which comprises a resilient element normally applying an urging force to the safety rotor such that it is normally locked in a locked position. Moreover, the urging force is of such a magnitude that an ordinary child is incapable of overcoming so as to prevent an ordinary child to unlock the utility lighter.

Another object of the present invention is to provide a utility lighter comprising a safety device which does not employ any complicated and expensive mechanical components so as to minimize the manufacturing cost and the ultimate selling price of the present invention.

Accordingly, in order to accomplish the above objects, the present invention provides a utility lighter, comprising:

a lighter housing having a fuel-storage cavity for storing a liquefied gas therein, an ignition cavity, an operation cavity, and an operation slot formed on the lighter housing to communicate the operation cavity to outside;

a gas valve upwardly extended from the fuel-storage cavity for release the gas therein when the gas valve is uplifted;

an ignition nozzle supported in the ignition cavity and communicated with the gas valve;

a piezoelectric unit disposed in the ignition cavity for generating piezoelectricity, wherein the piezoelectric unit has a movable part and a spark generating tip extended towards the ignition nozzle in such a manner that when the piezoelectric unit is compressed, a spark is generated at the spark generating tip for igniting the emitted gas through the ignition nozzle; and a safety device, which comprises:

a pusher button slidably mounted on the lighter housing along the operation slot, wherein the pusher button is adapted to vertically slide along the lighter housing by the pusher button to lift up the gas valve and to compress the piezoelectric unit at the same time;

a restraining latch transversely extended in the operation cavity;

a safety rotor, having a blocking latch, rotatably connected within the pusher button to move between a locked position and an unlocked position, wherein at the locked position, the blocking latch of the safety rotor is aligned with the restraining latch to lock up the pusher bottom from sliding upwardly, and at the unlocked position, the safety rotor is rotated at a direction opposite to a sliding movement of the pusher button to drive the blocking latch offset from the restraining latch, such that the pusher bottom is adapted to slide to ignite the utility lighter; and a resilient element supported within the operation cavity of the lighter housing to retain the safety rotor at the locked position.

These and other objectives, features, and advantages of the present invention will become apparent from the following detailed description, the accompanying drawings, and the appended claims.

DETAILED DESCRIPTION OF THE PREFERRED EMBODIMENT

Figure 1:
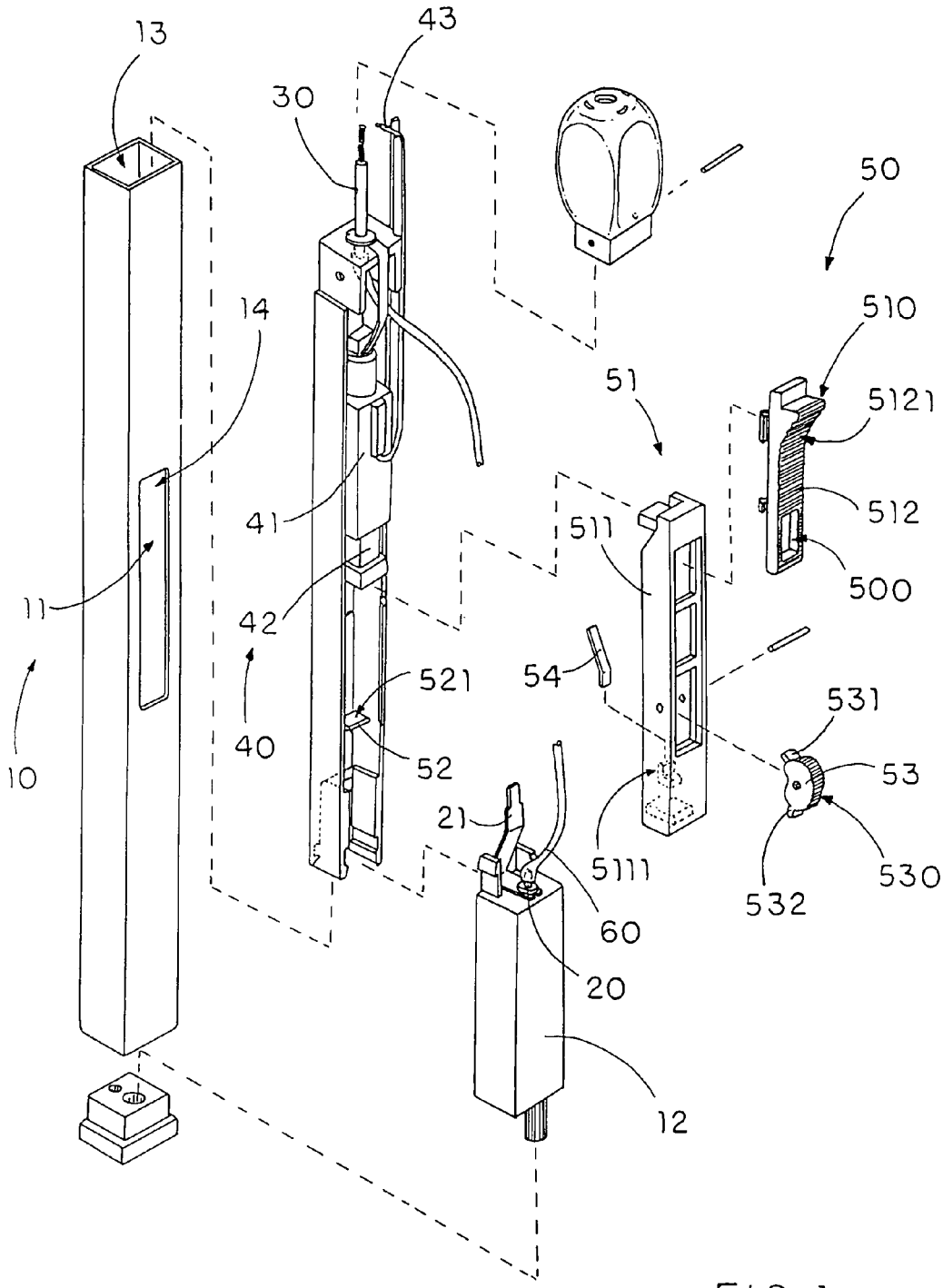
FIG. 1 is an exploded perspective view of a utility lighter according to a first preferred embodiment of the present invention.

Referring to FIG. 1 of the drawings, a utility lighter according to a preferred embodiment of the present invention is illustrated, in which the utility lighter comprises a lighter housing 10, a gas valve 20, an ignition nozzle 30, a piezoelectric unit 40, and a safety device 50.

The lighter housing 10 has a fuel-storage cavity 12 for storing liquefied gas therein, an ignition cavity 13, and an operation cavity 14, wherein an operation slot 11 is formed on the lighter housing 10 so as to communicate the operation cavity 14 with an outside of the lighter housing 10.

The utility lighter, 1 as shown in FIG. 1, is embodied as a barbecue lighter wherein the lighter housing 10 is an elongated housing that the bottom portion thereof forms as the fuel-storage cavity 12 and the upper portion forms as the ignition cavity 13 while the operation cavity 14 is formed between the fuel-storage cavity 12 and the ignition cavity 13.

The fuel-storage cavity 12 is adapted to be fueled with liquefied gas which is to be utilized to provide flame when properly ignited. The gas valve 20 is upwardly extended from the fuel-storage cavity 12 in such a manner that when it is uplifted, the liquefied gas stored in the fuel-storage cavity 12 will be released through the gas valve 20.

The ignition nozzle 30 is securely supported in the ignition cavity 13 of the lighter housing 10 of the utility lighter which further comprises a gas tube 60 communicating the ignition nozzle 30 and the gas valve 20, therefore, when the gas valve 20 is uplifted, the liquefied gas will be released and go to the ignition nozzle 30 via the gas tube 60.

The piezoelectric unit 40 is disposed in the ignition cavity 13 for generating piezoelectricity, wherein the piezoelectric unit 40 has a main body 41 mounted underneath the ignition nozzle 30, a movable part 42 slidably extended from the main body 41 and a spark generating tip 43 extended from the main body 41 towards the ignition nozzle 30 in such a manner that when the movable part 42 of the piezoelectric unit 40 is compressed, a spark will be generated at the spark generating tip 43 for igniting the liquefied gas coming out from the ignition nozzle 30.

The safety device 50 comprises a pusher button 51, a restraining latch 52, a safety rotor 53, and a resilient element 54. The pusher button 51, having a pusher portion 510 extended outwardly, is slidably mounted along the operation slot 11, and is adapted to vertically slide along the lighter housing 10 so as to lift up the gas valve 20 via a gas lever and to compress the piezoelectric unit 40 simultaneously. In other words, by pushing the pusher portion 510 of the pusher button 51, the utility lighter is arranged to be ignited.

Figure 2:
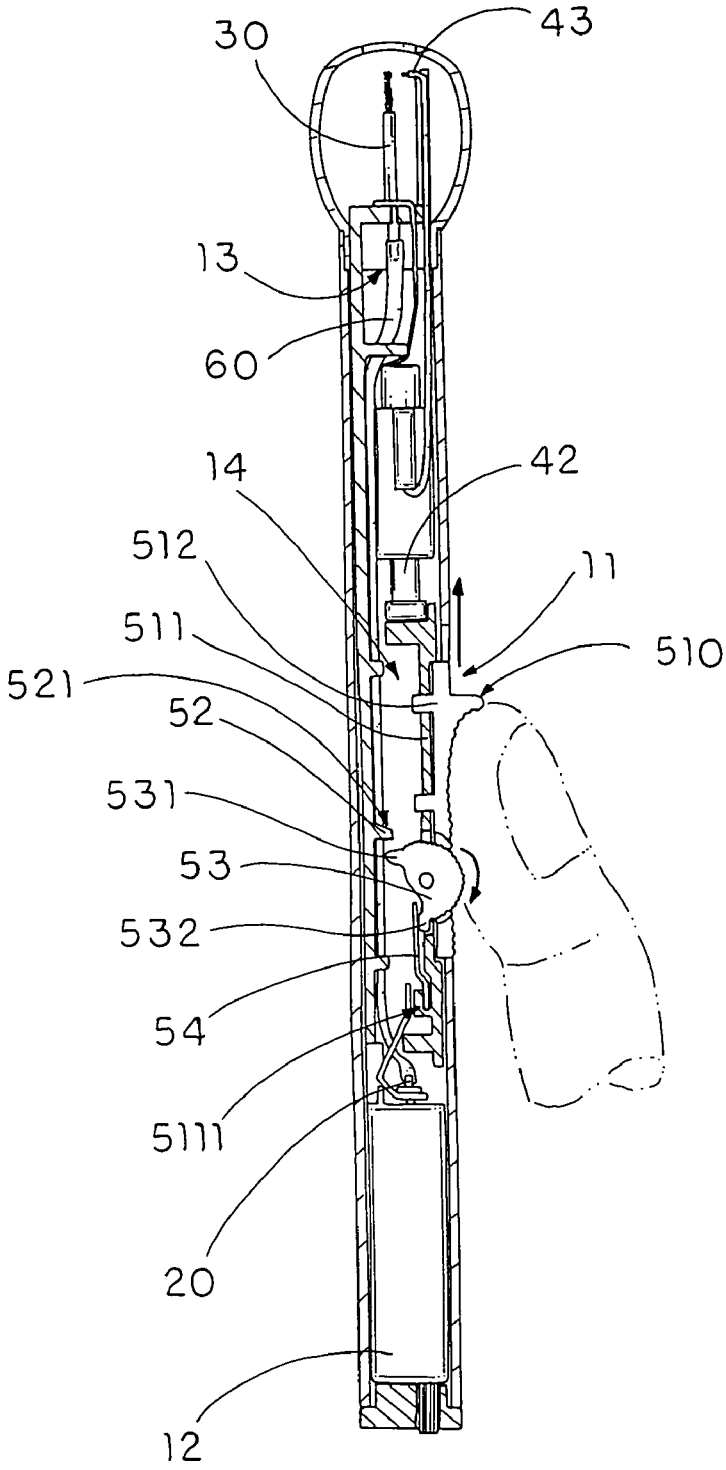
FIG. 2 is a sectional view of the utility lighter according to the above first preferred embodiment of the present invention.

Referring to FIG. 2 of the drawings, according to the preferred embodiment, the pusher button 51 comprises a transmission member 511 slidably supported in the operation cavity 14, and an actuation member 512, defining the pusher portion 510 thereon, outwardly extended from the transmission member 511 through the operation slot 11. In other words, by upwardly pushing the actuation member 512 from outside the lighter housing 10, the actuation member 512 is arranged to drive the transmission member 511 slidably and upwardly moving as well, thereby simultaneously uplifting the gas valve 20 and pressing the piezoelectric unit 40 for igniting the liquefied gaseous fuel coming out from the ignition nozzle 30.

The transmission member 511 has a body, an upper pressing end engaged with the movable part 42 of the piezoelectric unit 40, and a lower uplifting end operatively engaged with the gas valve 20 such that when the pusher portion 510 of the actuation button 512 is pushed upwardly, the transmission member 511 is driven upwardly to uplift the gas valve 20 and to compress the piezoelectric unit 40. As a result, the liquefied gas stored in the fuel-storage cavity will be released through at the ignition nozzle via the gas tube 60. At the same time, the upper pressing end portion is arranged to push to press the movable part 42 of the piezoelectric unit 40 so as to generate a spark at the ignition tip 43.

It is worth to mention that the movable part 42 is downwardly extended from the main body 41 to bias against the upper end of the transmission member 511 such that when the transmission member 511 is pushed upwardly, the movable part 42 is driven to move upwardly to the main body 41 so as to compress the piezoelectric unit 40.

The actuation member 512 has an outer engaging surface 5121 adapted for receiving a user's thumb resting thereon. Preferably, a plurality of anti-sliding teeth are formed on the engaging surface 5121 so that the engaging surface 5121 is capable of securely engaging with the user's thumb when it tries to push the pusher button 51 upwardly to ignite the utility lighter.

Figure 3:
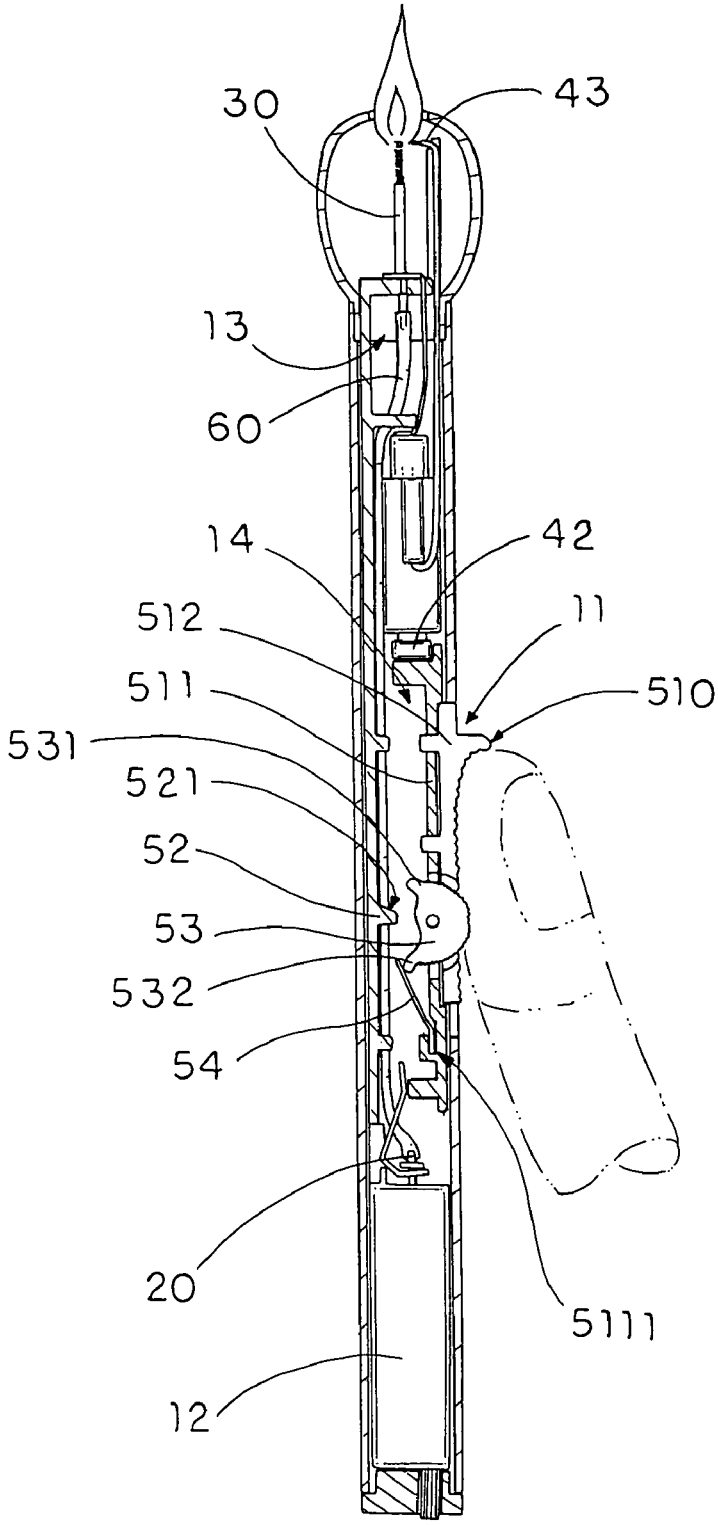
FIG. 3 is a sectional view of the utility lighter according to the above first preferred embodiment of the present invention, illustrating the utility lighter being ignited.

Referring to FIG. 2 and FIG. 3 of the drawings, the safety rotor 53, having a blocking latch 531, is rotatably mounted within a pusher cavity 500 of the pusher button 51 for moving between a locked position and an unlocked position, wherein in the locked position, the blocking latch 531 is substantially align with the restraining latch 52 so as to lock up the pusher button 51 from sliding upwardly (as shown in FIG. 2 of the drawings), and in the unlocked position, the safety rotor 53 is rotated at a direction opposite to the sliding movement of the pusher button 51, i.e. the downward direction, to drive the blocking latch 531 offset from the restraining latch 52, i.e. disaligning therefrom, such that the pusher button 51 is adapted to slidably move for igniting the utility lighter (as shown in FIG. 3 of the drawings).

According to the preferred embodiment, the safety rotor 53 is rotatably mounted on the pusher button 51 to define a thumb distance between the safety rotor 53 and the pusher portion 510 of the actuation member 512, wherein the thumb distance of the safety device 50 is configured for fitting an adult's thumb size which is big enough to downwardly rotate the safety rotor 53 and to upwardly lift up the pusher button 51 in one sequential manner while a child's thumb size is small to insufficiently reach the safety rotor 53 and the pusher portion 510 of the actuation member 512 at the same time.

The safety rotor 53 is rotatably mounted at the transmission member 511 between the upper and lower ends thereof, has a curved manipulating portion 530 outwardly protruded from the actuation member 512 in such a manner that when the manipulating portion 530 of the safety rotor 53 is rotated to drive the blocking latch 531 offset from the restraining latch 52, the actuation member 512 is allowed to drive the transmission member 511 to slide upwardly to ignite the utility lighter.

Moreover, a plurality of engaging teeth is also formed on the safety rotor 53 wherein the user's thumb can be able to securely engage with the safety rotor 53 for rotating it from the locked position to the unlocked position and then to push the pusher button 51 though the actuation member 512.

Accordingly, the restraining latch 52 is transversely extended in the operation cavity 14 and has a slanted guiding surface 521 formed at a free end of the restraining latch 52 to guide the blocking latch 531 of the safety rotor 53 to slide back to the locked position when the pusher button 51 is downwardly slid on the lighter housing 10. It is worth to mention that the restraining latch 52 is utilized to restraint an upward movement of the pusher button 51 so as to prevent the utility lighter from being accidentally or undesirably ignited as disclosed below.

The resilient element 54 is supported within the operation cavity 14 of the lighter housing 10 for retaining the safety rotor 53 at the locked position. The transmission member 511 further has a securing slot 5111 formed at an inner side thereof within the operation cavity 14 wherein the resilient element 54 has a biasing end portion and a securing end portion securely mounted in the securing slot 5111 of the transmission member 511 to substantially support the biasing end portion of the resilient element 54 to bias against the safety rotor 53 so as to retain the safety rotor 53 in the locked position.

According to the preferred embodiment, the resilient element 54 is embodied as a spring strip having a predetermined safety elastic strength which is arranged to normally apply an urging force to the safety rotor 53 so as to retain the safety rotor 53 in the locked position. Alternatively, the spring strip of the resilient element 54A is a coil spring having a biasing end portion and a securing end portion securely mounted in the securing slot 5111 of the transmission member 511 to substantially support the biasing end portion of the resilient element 54A to bias against the safety rotor 53A so as to retain the safety rotor 53A in the locked position, as shown in FIG. 4.

It is worth mentioning that the safety elastic strength of the resilient element 54 is such as to be sufficiently strong for overcome a rotating force which can be applied thereto by an ordinary child. In other words, it is intended that the ordinary child is unable to rotate the safety rotor 53 because of the strong resisting force applied thereto by the resilient element 54. In other words, the resilient element 54 is arranged to normally retain the safety rotor 53 in the locked position for resisting a child's thumb from rotating the safety rotor 53 to the unlocked position.

Moreover, the safety rotor 53 further has a retaining stopper 532 which is extended integrally to bias against the resilient element 54 and is arranged to block up a further rotational movement of the safety rotor 53 at a position that the blocking latch 531 is aligned with the restraining latch 52 so as to retain the safety rotor 53 at the locked position. As shown in FIG. 2, the retaining stopper 532 is embodied as a stopper arm integrally extended to have a first side biasing against the resilient element 54 and a second side biasing against the transmission member 511. Accordingly, after every ignition, the safety rotor 53 is forced to rotate back by the resilient element 54 such that the retaining stopper 532 is arranged to stop the further rotational movement of the safety rotor 53 to ensure the alignment between the blocking latch 531 and the restraining latch 52. Alternatively, the retaining stopper 532A is attached to the safety rotor 53A at a position that the retaining stopper 532A is biased against the transmission member 511 to stop the further rotational movement of the safety rotor 53A, as shown in FIG. 4.

Figure 4:
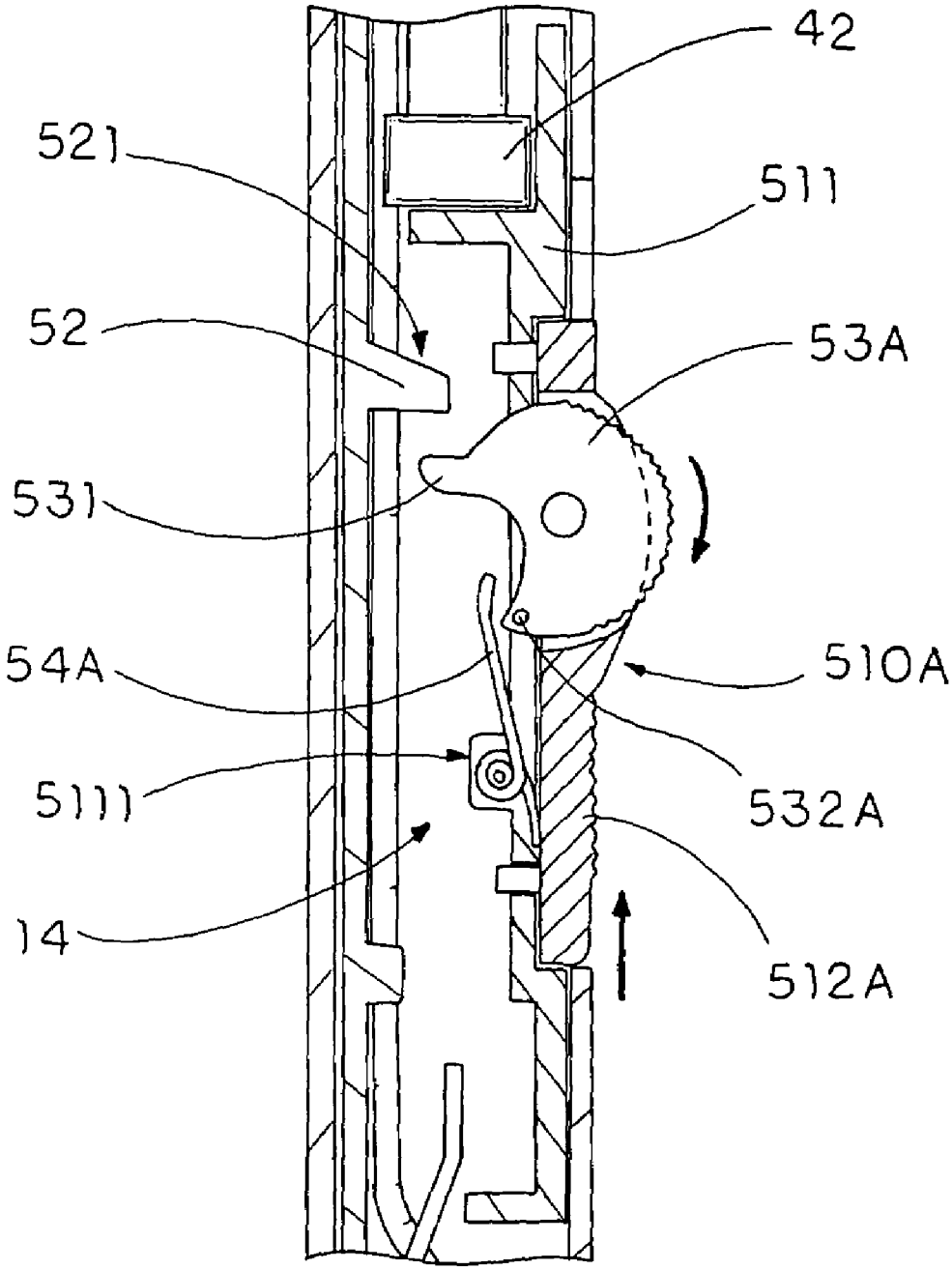
FIG. 4 illustrates an alternative mode of the safety device of the utility lighter according to the above first preferred embodiment of the present invention.

In addition, the safety rotor 53A is rotatably mounted at a position above the pusher portion 510A of the actuation member 512A such that the user must downwardly rotate the safety rotor 53A to remain the blocking latch 531A at a position that offset from the restraining latch 52 such that the pusher portion 510A is allowed to push upwardly to ignite the utility lighter, as shown in FIG. 4.

The operation of the utility lighter is explained as follows: the safety rotor 53 is normally retained in the locked position by the resilient element 54. When the user wants to actuate the utility lighter, two principal steps must be taken. First, he/she has to downwardly rotate the safety rotor 53 such that the blocking latch 531 is rotated to disalign with the restraining latch 521. At the same time, the retaining stopper 532 is driven to bias against an upper end portion of the resilient element 54 for overcoming the normal urging force applied to the safety rotor 53. As such, the safety rotor 53 is cleared from obstructions for sliding upwardly along the operation slot 11. In other words, the safety rotor 53 is rotated to the unlocked position.

Second, when the safety rotor 53 is in the unlocked position, the user has to retain the safety rotor 53 in the unlocked position and at the same time push the pusher button 51 upwardly along the operation slot 11 until the gas valve 20 is uplifted and the piezoelectric unit 40 is compressed, thereby producing a spark at the ignition nozzle 30 at which the liquefied gas is coming out. The consequence is that the liquefied gas will be ignited and lighter flame is generated.

To summarize, in order for a user to ignite the utility lighter, the user has to move his/her thumb a safety distance its constituents being the sum of the distance in rotating the safety rotor 53 from the locked position to the unlocked position, and the distance for pushing the pusher button 51 up to ignite the utility lighter. Nothing short of that safety distance is sufficient to ignite the utility lighter.

With respect to this, it is important to point out that the safety distance is arranged to be traveled by an adult's thumb and that for a child's thumb which is usually smaller in size, it is incapable of accomplishing the whole safety distance thereby igniting the utility lighter.

When the user finishes using the utility lighter, he/she only needs to release the upward pushing force applied to the pusher button 51 and the rotating force applied to the safety rotor 53. Then, the piezoelectric unit 40 will rebound back to its original position, thus downwardly pushing the pusher button 51 back to its original position, and the resilient element 54 will apply the normal urging force to the retaining stopper 532 of the safety rotor 53 so as to push the safety rotor 53 rotating back to the locked position.

Furthermore, the slanted guiding surface 521 of the restraining latch 52 will guide the pusher button 51 moving into the original position.

Figure 5:
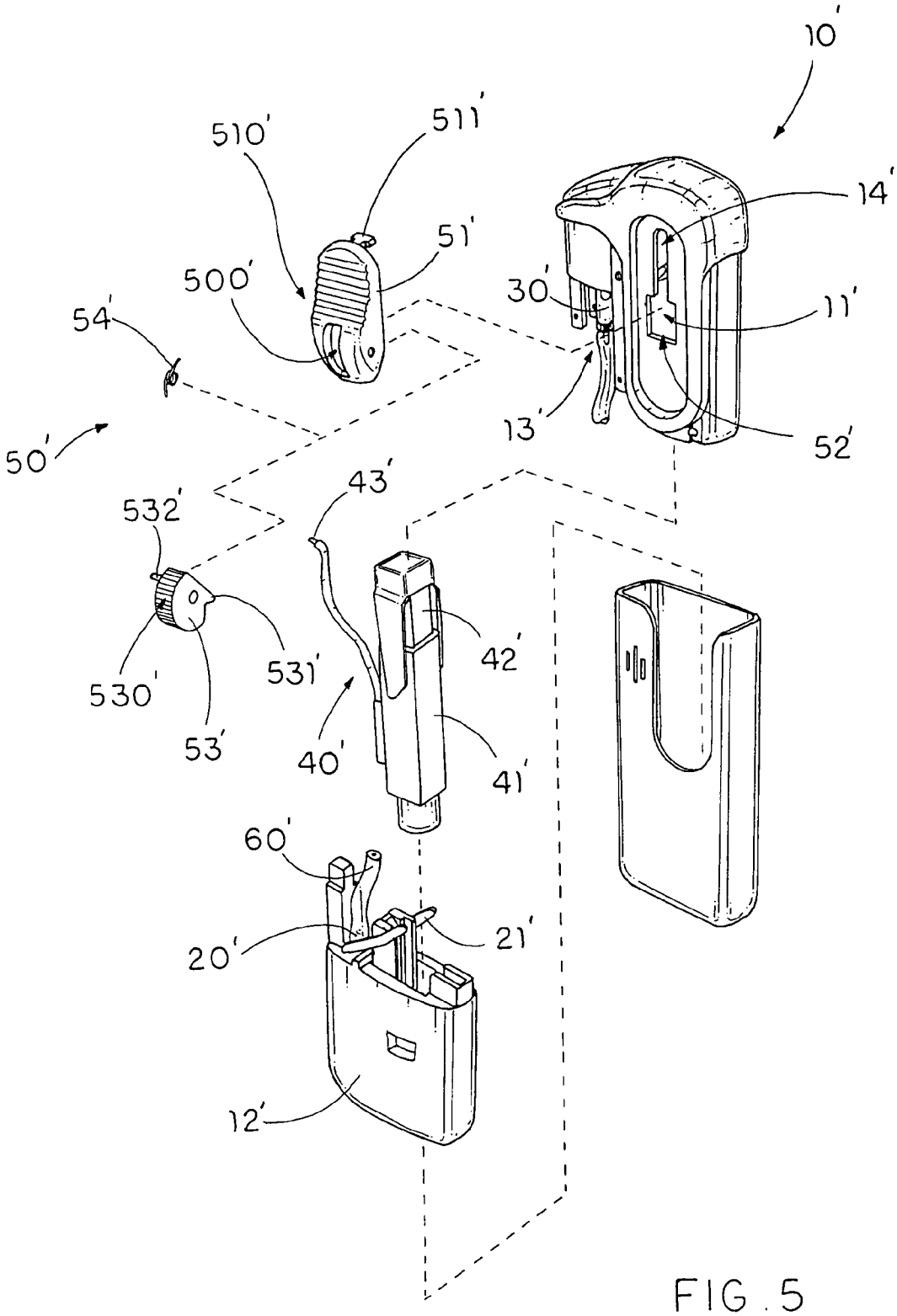
FIG. 5 is a sectional view of a utility lighter according to a second preferred embodiment of the present invention.

Referring to FIG. 5 of the drawings, the utility lighter according to a second embodiment illustrates an alternative mode of the first embodiment of the present invention, wherein the utility lighter according to the second embodiment is embodied as a piezoelectric lighter.

The utility lighter comprises a lighter housing 10', a gas valve 20', an ignition nozzle 30', a piezoelectric unit 40', and a safety device 50'. The lighter housing 10' has a fuel-storage cavity 12' for storing liquefied gas therein, an ignition cavity 13', and an operation cavity 14', wherein an operation slot 11' is formed on the lighter housing 10' so as to communicate the operation cavity 14' with an outside of the lighter housing 10'.

The gas valve 20' is upwardly extended from the fuel-storage cavity 12' in such a manner that when it is uplifted, the liquefied gas stored in the fuel-storage cavity 12' will be released through the gas valve 20'.

The ignition nozzle 30' is securely supported in the ignition cavity 13' of the lighter housing 10' which further comprises a gas tube 60' communicating the ignition nozzle 30' and the gas valve 20', therefore, when the gas valve 20' is uplifted, the liquefied gas will be released and go to the ignition nozzle 30' via the gas tube 60'.

The piezoelectric unit 40' is disposed in the ignition cavity 13' for generating piezoelectricity, wherein the piezoelectric unit 40' has a main body 41' mounted underneath the ignition nozzle 30', a movable part 42' slidably extended from the main body 41' and a spark generating tip 43' extended from the main body 41' towards the ignition nozzle 30' in such a manner that when the movable part 42' of the piezoelectric unit 40' is compressed, a spark will be generated at the spark generating tip 43' for igniting the liquefied gas coming out from the ignition nozzle 30'.

The safety device 50' comprises a pusher button 51', a restraining latch 52', a safety rotor 53, and a resilient element 54'. The pusher button 51', having a pusher portion 510' extended outwardly, is slidably mounted along the operation slot 11', and is adapted to vertically slide along the lighter housing 10' so as to lift up the gas valve 20' and to compress the piezoelectric unit 40' simultaneously. In other words, by pushing the pusher portion 510' of the pusher button 51', the utility lighter is arranged to be ignited.

Figure 6:
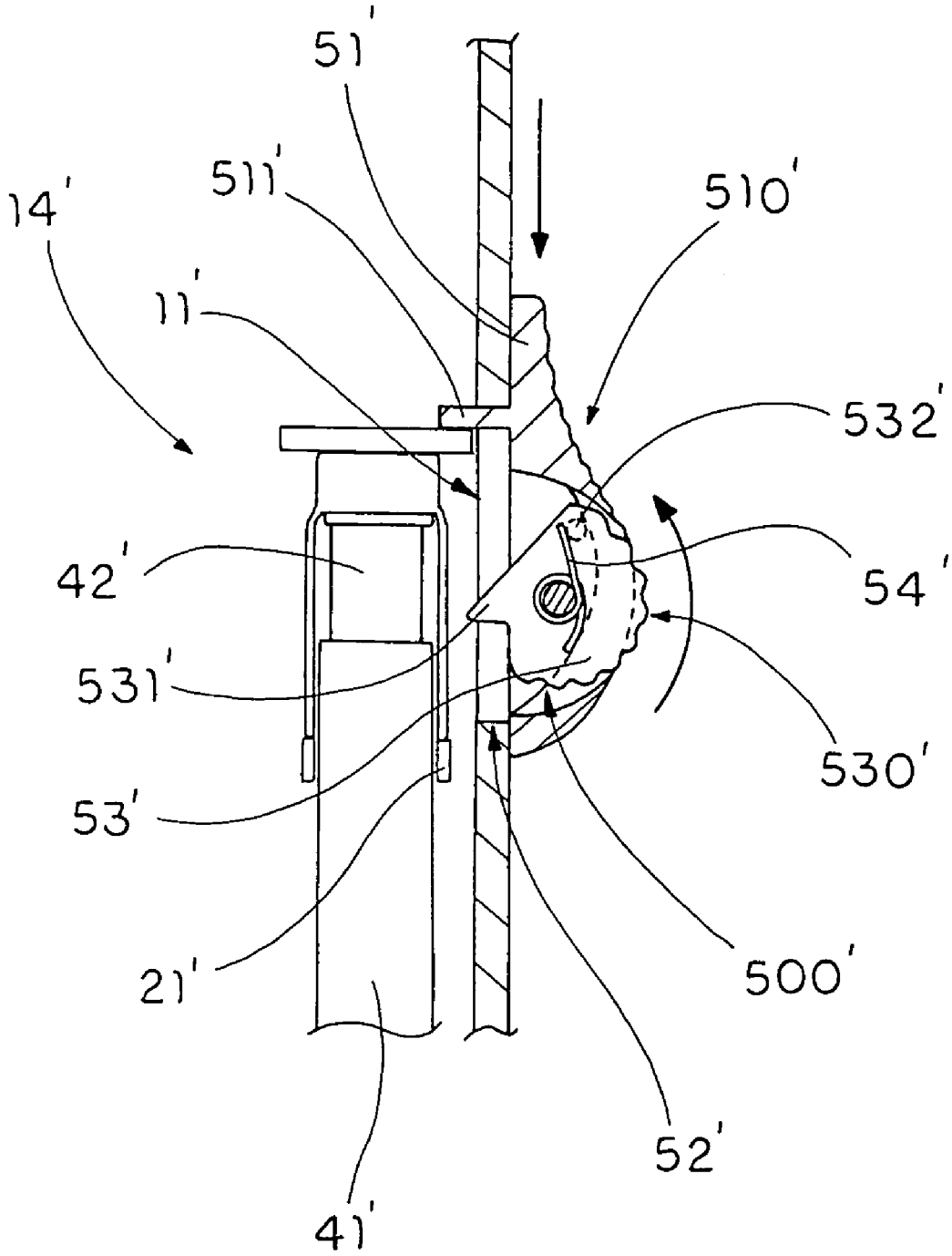
FIG. 6 is a sectional view of the safety device of the utility lighter according to the above second preferred embodiment of the present invention.

As shown in FIG. 6, the pusher button 51' comprises an actuation arm 511' extended into the operation cavity 14' at a position on top of the movable part 42' of the piezoelectric unit 40' such that when the pusher button 51' is slid downwardly, the piezoelectric unit 40' is depressed to generate the spark at the spark generating tip 43'. At the same time, the downward sliding movement of the pusher button 51' will lift up the gas valve 20' via a gas lever 21'.

The safety rotor 53', having a blocking latch 531', is rotatably mounted within a pusher cavity 500' of the pusher button 51' for moving between a locked position and an unlocked position, wherein at the locked position, the blocking latch 531' of the safety rotor 53' is substantially align with the restraining latch 52' so as to lock up the pusher button 51' from sliding downwardly. At the unlocked position, the safety rotor 53' is rotated at a direction opposite to the sliding movement of the pusher button 51', i.e. the upward direction, to drive the blocking latch 531' offset from the restraining latch 52', i.e. disaligning therefrom, such that the pusher button 51' is adapted to slidably move for igniting the utility lighter.

As shown in FIG. 6, the restraining latch 52' is formed at a bottom edge of the operation slot 11' such that the blocking latch 531' is normally positioned above the restraining latch 52' so as to block the downward sliding movement of the pusher button 51' to ignite the utility lighter. When the safety rotor 53' is upwardly rotated to drive the blocking latch 531' out of the operation slot 11' that offsets from the restraining latch 52', the pusher button 51' is allowed to slide downwardly to ignite the utility lighter.

According to the second embodiment, the pusher cavity 500' is formed at the pusher portion 510' of the pusher button 51' to communicate with the operation slot 11', wherein the safety rotor 53' is rotatably supported within the pusher cavity 500' such that when the safety rotor 53' is rotated at the unlocked position, the pusher portion 510' of the pusher button 51' is allowed to be pushed downwardly so as to enhance the practice use of the utility lighter.

The safety rotor 53' has a curved manipulating portion 530' outwardly protruded from the pusher cavity 500' such that the adult user's thumb is able to easily contact with the manipulating portion 530' of the safety rotor 53' to unlock the utility lighter.

Figure 7:
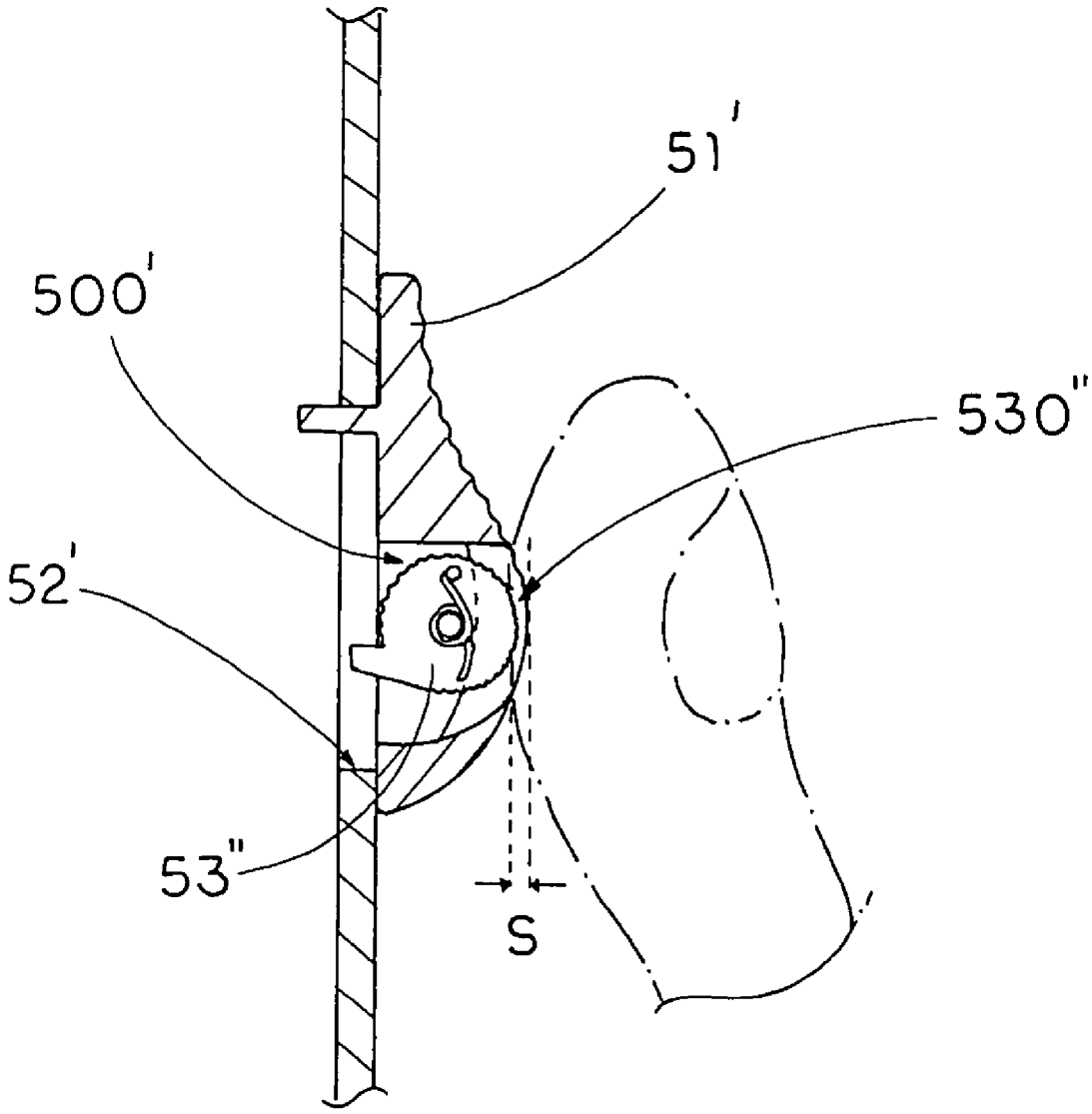
FIG. 7 illustrates an alternative mode of the safety device of the utility lighter according to the above second preferred embodiment of the present invention.

Alternatively, the manipulating portion 530" of the safety rotor 53' is positioned below an outer wall of the pusher cavity 500' to define a safety clearance S such that the adult user must deform his or her thumb to contact with the manipulating portion 530" of the safety rotor 53' in order to unlock the utility lighter so as to enhance the safety feature of the utility lighter, as shown in FIG. 7.

The safety rotor 53' further has a retaining stopper 532' extended within the pusher cavity 500' to bias against an inner wall thereof so as to block up a further rotational movement of the safety rotor 53' to retain the safety rotor 53' at the locked position.

The resilient element 54' is supported within the pusher cavity 500' of the pusher button 51' for retaining the safety rotor 53' at the locked position. The resilient element 54' is embodied as a coil spring having two ends biasing against the pusher button 51' and the inner wall of the pusher cavity 500' respectively so as to retain the safety rotor 53' in the locked position, as shown in FIG. 6.

Accordingly, the coil spring of the resilient element 54' is substantially mounted to the safety rotor 53' wherein the two ends of the resilient element 54' is arranged to bias against the retaining stopper 532' of the safety rotor 53' and the inner wall of the pusher cavity 500' such that the coil spring of the resilient element 54' normally applies an urging force against the safety rotor 53' so as to retain the safety rotor 53' at the locked position.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A utility lighter, comprising:

a lighter housing having a fuel-storage cavity for storing a liquefied gas therein, an ignition cavity, an operation cavity and said ignition cavity, and an operation slot formed on said lighter housing to communicate said operation cavity to outside;

a gas valve upwardly extended from said fuel-storage cavity for release said gas therein when said gas valve is uplifted;

an ignition nozzle supported in said ignition cavity and communicated with said gas valve;

a piezoelectric unit disposed in said ignition cavity for generating piezoelectricity, wherein said piezoelectric unit has a movable part and a spark generating tip extended towards said ignition nozzle in such a manner that when said piezoelectric unit is compressed, a spark is generated at said spark generating tip for igniting said emitted gas through said ignition nozzle; and a safety device, which comprises:

a pusher button, having a pushing portion, slidably mounted on said lighter housing along said operation slot, wherein when a pushing force is applied on said pushing portion of said pusher button, said pusher button is vertically slid along said lighter housing to lift up said gas valve and to compress said piezoelectric unit at said same time;

a restraining latch provided at said operation cavity;

a safety rotor, having a blocking latch, rotatably mounted at said pusher button to move between a locked position and an unlocked position, wherein at said locked position, said blocking latch of said safety rotor is aligned with said restraining latch to lock up said pusher bottom from sliding vertically, and at said unlocked position, said safety rotor is rotated at a direction opposite to a sliding movement of said pusher button to drive said blocking latch offset from said restraining latch, such that said pusher bottom is adapted to slide on said lighter housing to ignite said utility lighter; and a resilient element supported at said pusher button to retain said safety rotor at said locked position.

2. The utility lighter, as recited in claim 1, wherein said safety rotor is rotatably mounted on said pusher button to define a thumb distance between said safety rotor and said pusher portion of said pusher button, wherein said thumb distance of said safety device is configured for fitting an adult's thumb size which is big enough to downwardly rotate said safety rotor and to upwardly lift up said pusher button in one sequential manner while a child's thumb size is small to insufficiently reach said safety rotor and said pusher portion of said pusher button at the same time.

3. The utility lighter, as recited in claim 1, wherein said resilient element is a spring strip having a predetermined elastic strength adapted to normally bias against said safety rotor so as to normally retain said safety rotor in said locked position for resisting a child's thumb from rotating said safety rotor to said unlocked position.

4. The utility lighter, as recited in claim 2, wherein said resilient element is a spring strip having a predetermined elastic strength adapted to normally bias against said safety rotor so as to normally retain said safety rotor in said locked position for resisting said child's thumb from rotating said safety rotor to said unlocked position.

5. The utility lighter, as recited in claim 1, wherein said pusher button comprises an actuation member defining said pusher portion thereon, and a transmission member slidably supported in said operation cavity to connect with said actuation button through said operation slot, wherein said transmission member has an upper end engaged with said movable part of said piezoelectric unit and an lower end engaged with said gas valve in such a manner when said pusher portion of said actuation button is pushed upwardly, said transmission member is driven upwardly to lift up said gas valve and to compress said piezoelectric unit at the same time, so as to ignite said utility lighter.

6. The utility lighter, as recited in claim 2, wherein said pusher button comprises an actuation member defining said pusher portion thereon, and a transmission member slidably supported in said operation cavity to connect with said actuation button through said operation slot, wherein said transmission member has an upper end engaged with said movable part of said piezoelectric unit and an lower end engaged with said gas valve in such a manner when said pusher portion of said actuation button is pushed upwardly, said transmission member is driven upwardly to lift up said gas valve and to compress said piezoelectric unit at the same time, so as to ignite said utility lighter.

7. The utility lighter, as recited in claim 3, wherein said pusher button comprises an actuation member defining said pusher portion thereon, and a transmission member slidably supported in said operation cavity to connect with said actuation button through said operation slot, wherein said transmission member has an upper end engaged with said movable part of said piezoelectric unit and an lower end engaged with said gas valve in such a manner when said pusher portion of said actuation button is pushed upwardly, said transmission member is driven upwardly to lift up said gas valve and to compress said piezoelectric unit at the same time, so as to ignite said utility lighter.

8. The utility lighter, as recited in claim 4, wherein said pusher button comprises an actuation member defining said pusher portion thereon, and a transmission member slidably supported in said operation cavity to connect with said actuation button through said operation slot, wherein said transmission member has an upper end engaged with said movable part of said piezoelectric unit and an lower end engaged with said gas valve in such a manner when said pusher portion of said actuation button is pushed upwardly, said transmission member is driven upwardly to lift up said gas valve and to compress said piezoelectric unit at the same time, so as to ignite said utility lighter.

9. The utility lighter, as recited in claim 6, wherein said safety rotor, which is rotatably mounted at said transmission member between said upper and lower ends thereof, has a curved manipulating portion outwardly protruded from said actuation member in such a manner that when said manipulating portion of said safety rotor is rotated to drive said blocking latch offset from said restraining latch, said actuation member is allowed to drive said transmission member to slide upwardly to ignite said utility lighter.

10. The utility lighter, as recited in claim 7, wherein said safety rotor, which is rotatably mounted at said transmission member between said upper and lower ends thereof, has a curved manipulating portion outwardly protruded from said actuation member in such a manner that when said manipulating portion of said safety rotor is rotated to drive said blocking latch offset from said restraining latch, said actuation member is allowed to drive said transmission member to slide upwardly to ignite said utility lighter.

11. The utility lighter, as recited in claim 8, wherein said safety rotor, which is rotatably mounted at said transmission member between said upper and lower ends thereof, has a curved manipulating portion outwardly protruded from said actuation member in such a manner that when said manipulating portion of said safety rotor is rotated to drive said blocking latch offset from said restraining latch, said actuation member is allowed to drive said transmission member to slide upwardly to ignite said utility lighter.

12. The utility lighter, as recited in claim 9, wherein said safety rotor further comprises a retaining stopper which is extended integrally to bias against said resilient element and is arranged to block up a further rotational movement of said safety rotor at a position that said blocking latch is aligned with said restraining latch so as to retain said safety rotor at said locked position.

13. The utility lighter, as recited in claim 10, wherein said safety rotor further comprises a retaining stopper which is extended integrally to bias against said resilient element and is arranged to block up a further rotational movement of said safety rotor at a position that said blocking latch is aligned with said restraining latch so as to retain said safety rotor at said locked position.

14. The utility lighter, as recited in claim 11, wherein said safety rotor further comprises a retaining stopper which is extended integrally to bias against said resilient element and is arranged to block up a further rotational movement of said safety rotor at a position that said blocking latch is aligned with said restraining latch so as to retain said safety rotor at said locked position.

15. The utility lighter, as recited in claim 6, wherein said transmission member has a securing slot formed at an inner side thereof, wherein said resilient element has a biasing end portion and a securing end portion securely mounted in said securing slot of said transmission member to substantially support said biasing end portion of said resilient element to bias against said safety rotor so as to retain said safety rotor in said locked position.

16. The utility lighter, as recited in claim 7, wherein said transmission member has a securing slot formed at an inner side thereof, wherein said resilient element has a biasing end portion and a securing end portion securely mounted in said securing slot of said transmission member to substantially support said biasing end portion of said resilient element to bias against said safety rotor so as to retain said safety rotor in said locked position.

17. The utility lighter, as recited in claim 14, wherein said transmission member has a securing slot formed at an inner side thereof, wherein said resilient element has a biasing end portion and a securing end portion securely mounted in said securing slot of said transmission member to substantially support said biasing end portion of said resilient element to bias against said safety rotor so as to retain said safety rotor in said locked position.

18. The utility lighter, as recited in claim 6, wherein said restraining latch has a slanted guiding surface formed at a free end thereof to guide said blocking latch of said safety rotor to slide back to said locked position when said pusher button is downwardly slid on said lighter housing.

19. The utility lighter, as recited in claim 7, wherein said restraining latch has a slanted guiding surface formed at a free end thereof to guide said blocking latch of said safety rotor to slide back to said locked position when said pusher button is downwardly slid on said lighter housing.

20. The utility lighter, as recited in claim 17, wherein said restraining latch has a slanted guiding surface formed at a free end thereof to guide said blocking latch of said safety rotor to slide back to said locked position when said pusher button is downwardly slid on said lighter housing.

21. The utility lighter, as recited in claim 1, wherein said restraining latch is formed at a bottom edge of said operation slot such that said blocking latch is normally positioned above said restraining latch to block a downward sliding movement of said pusher button for ignition, wherein when safety rotor is upwardly rotated to drive said blocking latch out of said operation slot that offsets from said restraining latch, said pusher button is allowed to slide downwardly for ignition.

22. The utility lighter, as recited in claim 1, wherein said pusher button has a pusher cavity formed at said pusher portion to communicate with said operation slot, wherein said safety rotor is rotatably supported within said pusher cavity such that safety rotor is rotated at said unlocked position, said pusher portion of said pusher button is allowed to be pushed upwardly for enhancing said ignition of said utility lighter.

23. The utility lighter, as recited in claim 21, wherein said pusher button has a pusher cavity formed at said pusher portion to communicate with said operation slot, wherein said safety rotor is rotatably supported within said pusher cavity such that safety rotor is rotated at said unlocked position, said pusher portion of said pusher button is allowed to be pushed upwardly for enhancing said ignition of said utility lighter.

24. The utility lighter, as recited in claim 22, wherein said safety rotor further has a retaining stopper extended within said pusher cavity to bias against an inner wall thereof so as to block up a further rotational movement of said safety rotor to retain said safety rotor at said locked position.

25. The utility lighter, as recited in claim 23, wherein said safety rotor further has a retaining stopper extended within said pusher cavity to bias against an inner wall thereof so as to block up a further rotational movement of said safety rotor to retain said safety rotor at said locked position.

26. The utility lighter, as recited in claim 24, wherein said resilient element, which is supported within said pusher cavity of said pusher button, comprises a coil spring having two ends biasing against said retaining stopper of said pusher button and said inner wall of said pusher cavity respectively so as to retain said safety rotor in said locked position.

27. The utility lighter, as recited in claim 25, wherein said resilient element, which is supported within said pusher cavity of said pusher button, comprises a coil spring having two ends biasing against said retaining stopper of said pusher button and said inner wall of said pusher cavity respectively so as to retain said safety rotor in said locked position.

28. The utility lighter, as recited in claim 22, wherein said safety rotor has a manipulating portion positioned below an outer wall of said pusher cavity.

29. The utility lighter, as recited in claim 23, wherein said safety rotor has a manipulating portion positioned below an outer wall of said pusher cavity.

30. The utility lighter, as recited in claim 25, wherein said safety rotor has a manipulating portion positioned below an outer wall of said pusher cavity.

31. The utility lighter, as recited in claim 27, wherein said safety rotor has a manipulating portion positioned below an outer wall of said pusher cavity.

* * * * *